US006123210A

United States Patent [19]

Kim

[11] Patent Number: 6,123,210

[45] Date of Patent: Sep. 26, 2000

[54] NURSING BOTTLE WITH MULTIUSE CAP

[76] Inventor: Jae-Hoon Kim, 19/9, 107, Dangsan-dong 2ga, Youngdeungpo-ku, Seoul 150-042, Rep. of Korea

[21] Appl. No.: 09/085,009

[22] Filed: May 28, 1998

[30] Foreign Application Priority Data

Mar. 10, 1998 [KR] Rep. of Korea ..... 98-3453

[51] Int. Cl.[7] ..... A61J 9/06; A61J 9/08

[52] U.S. Cl. ..... 215/11.6; 215/11.1; 215/395; 220/379

[58] Field of Search ..... 220/379; 215/11.1, 215/11.6, 383, 396, 395

[56] References Cited

U.S. PATENT DOCUMENTS

| | | | |
|---|---|---|---|
| 139,958 | 6/1873 | Hobson | 215/11.1 |
| 243,547 | 6/1881 | Goldsmith | 215/383 |
| 874,942 | 12/1907 | Cook | 215/11.1 |
| 1,649,580 | 11/1927 | Geisler | 215/11.6 |
| 2,957,596 | 10/1960 | Rehborg | 220/379 X |
| 3,512,301 | 5/1970 | Kramer | 215/11.6 X |
| 3,627,161 | 12/1971 | Wergeland | 215/11.3 X |
| 3,963,206 | 6/1976 | Scolaro et al. | 215/396 X |
| 3,990,596 | 11/1976 | Hoftman | 215/396 X |
| 4,941,579 | 7/1990 | Lee | 215/396 X |
| 5,211,299 | 5/1993 | Manfredonia | 215/11.1 |
| 5,269,426 | 12/1993 | Morano | 215/11.6 |

*Primary Examiner*—Sue A. Weaver

[57] ABSTRACT

A nursing bottle contains a cap which is also designed and positioned to further have a propping function whereby an infant can suck on a nipple by merely grasping the nursing bottle, but without lifting it. By providing a secondary location for fixing the cap to the bottle, the possible loss of the cap can be avoided.

4 Claims, 2 Drawing Sheets

NURSING BOTTLE WITH MULTIUSE CAP

FIELD OF THE INVENTION

The invention relates to a nursing bottle; and, more specifically, it pertains to a nursing bottle wherein the cap is designed to further have a propping function, thereby enabling the infant to suck on the nipple in a comfortable posture.

BACKGROUND OF THE INVENTION

Existing nursing bottles have problems wherein the contents thereof do not flow out smoothly or leak because of the folding of the nipple if the bottom thereof is not lifted by hand. Accordingly, in order to make the contents flow out smoothly, infants must grasp the nursing bottle by their hand during feeding, which has a problem in that it introduces a significant burden to the infants.

Further, while the nursing bottle is being used, the cap is separated from the nursing bottle and accordingly is easily mislaid or even lost.

SUMMARY OF THE INVENTION

Accordingly, it is a primary object of the present invention to provide a nursing bottle which enables an infant to suck on the nipple in a comfortable posture while preventing the loss of the cap.

In accordance with the present invention, there is provided a nursing bottle wherein the cap is designed to be attached at a right angle to one side of the nursing bottle, particularly near the bottom thereof, so that the cap can function as a prop in order to enable the infant to suck from the nipple without lifting the nursing bottle.

BRIEF DESCRIPTION OF THE DRAWINGS

The preferred embodiments of the present invention will become apparent from the following description of the invention, when taken in conjunction with the accompanying drawings, in which.

DETAILED DESCRIPTION OF THE INVENTION

Figure 1:
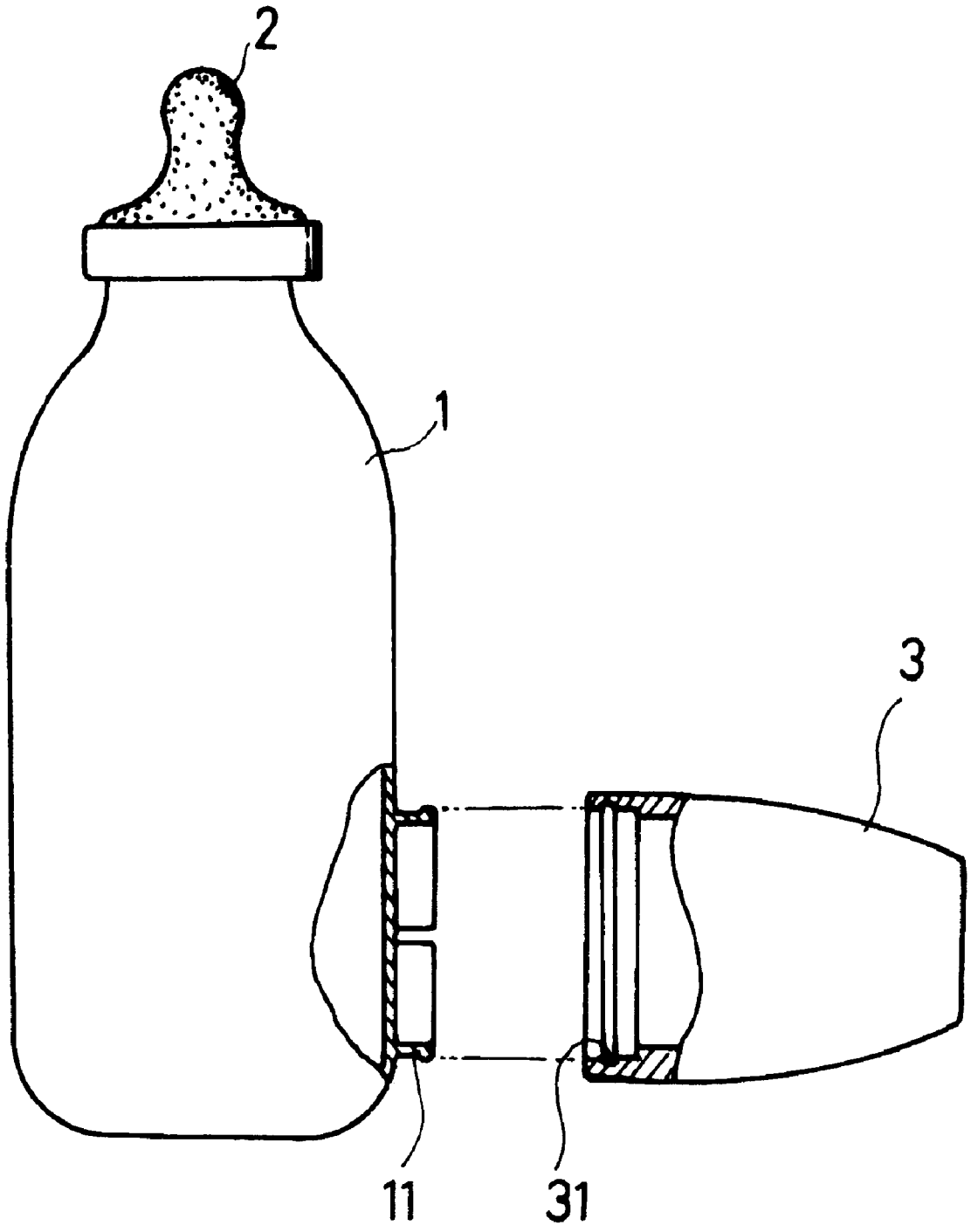
FIG. 1 shows an embodiment of the present invention wherein the nursing bottle and the cap are separated from each other.

FIG. 1 shows the nursing bottle of the present invention, wherein a cap (3) is separated from the nursing bottle (1). the nursing bottle, which is provided with a nipple (2), is opened or shut by the cap. Further, the cap is designed to be joined at a right angle to one side of the nursing bottle, near the bottom thereof, so that the cap functions as a prop in order to enable the infant to suck the nipple without lifting the nursing bottle.

More specifically, a connecting part (11) is formed on the nursing bottle and a complementary groove (31) is formed on the cap so that the cap can join with and separate from the nursing bottle in a convenient manner. The cap is designed to be longer than the conventional cap so that there is no need for the infant to lift the nursing bottle. Also, the position of the cap may be suitably located below the middle of the nursing bottle. Advantageously, the location of the cap can be varied toward the bottom of the bottle, realizing that the grade increases as the cap is located at the rear position.

Figure 2:
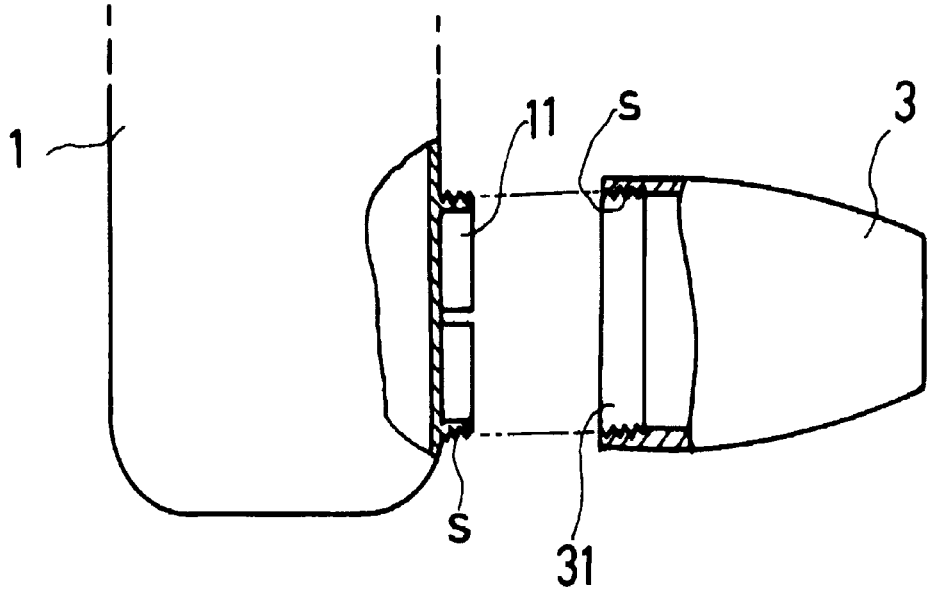
FIG. 2 depicts another embodiment of the present invention.
Figure 3:
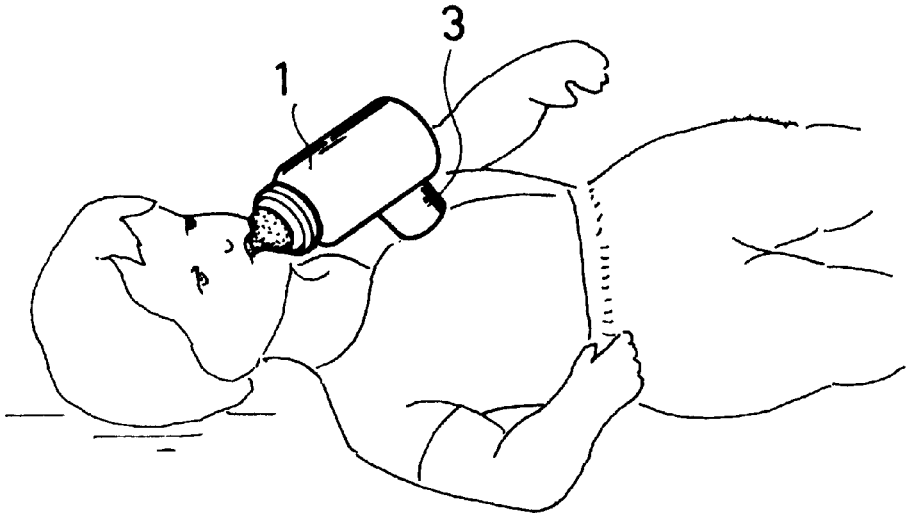
FIG. 3 illustrates the use of the nursing bottle of the present invention.

FIG. 2 shows another embodiment of the present invention wherein threaded parts (S) are provided on the connecting part (11) and on the joining groove (31) so that the nursing bottle and the cap can be connected together by screw engagement.

Like a conventional nursing bottle, the nursing bottle of the present invention can be capped at its top when it is not in use. When using the nursing bottle, the cap is separated from the top of the nursing bottle which contains a liquid such as milk, and then re-connected at a right angle to the bottom of the nursing bottle at the connecting part (11) provided at one side of the nursing bottle. the cap can be attached by a press-fit or by screw engagement. Thereafter, when the infant is allowed to take the nipple in its mouth with the cap of the nursing bottle facing downward, the nursing bottle is naturally inclined so that the infant can suck on the nipple while grasping the nursing bottle, but without lifting it.

Furthermore, the present invention is also advantageous in that the loss of the cap can be prevented by joining of the nursing bottle and the cap.

As discussed above, the nursing bottle of the present invention is advantageously designed so that the cap provides a propping function, thereby enabling the infant to suck the nipple in a comfortable posture.

While the invention has been described with respect to the above specific embodiments, it should be recognized that various modifications and changes may be made to the invention by those skilled in the art which also fall within the scope of the invention as defined by the appended claims.

What is claimed is:

1. A nursing bottle provided with a nipple and a cap, first connecting means for attaching said cap to the top of said bottle to cover said nipple, second connecting means for attaching said cap to the lower, side portion of said bottle, wherein said cap can be selectively positioned at the top of the bottle to protect the nipple when the bottle is not in use or at the side, along the lower portion of the bottle to provide a propping function when the bottle is being used.

2. The nursing bottle of claim 1, wherein the cap is larger than traditional caps so that a suitable angle for facilitating the nursing function can be achieved.

3. The nursing bottle of claim 1, wherein the first and second connecting means is either a press-fit engagement or screw engagement.

4. The nursing bottle of claim 1, wherein the second connecting means is located below the middle of the nursing bottle.

* * * * *